United States Patent [19]

Takeuchi

[11] Patent Number: 4,766,795

[45] Date of Patent: Aug. 30, 1988

[54] TONE SYNTHESIS METHOD USING MODULATION OPERATION FOR AN ELECTRONIC MUSICAL INSTRUMENT

[75] Inventor: Chifumi Takeuchi, Hamamatsu, Japan

[73] Assignee: Nippon Gakki Seizo Kabushiki Kaisha, Hamamatsu, Japan

[21] Appl. No.: 659,574

[22] Filed: Oct. 10, 1984

[30] Foreign Application Priority Data

Oct. 14, 1983 [JP] Japan ..... 190869

[51] Int. Cl.[4] ..... G10H 1/14; G10H 7/00

[52] U.S. Cl. ..... 84/1.01; 84/1.22; 84/1.24

[58] Field of Search ..... 84/1.24, 1.22, 1.01

[56] References Cited

U.S. PATENT DOCUMENTS

| | | | |
|---|---|---|---|
| 4,018,121 | 3/1977 | Chowning | 84/1.01 |
| 4,386,547 | 6/1983 | Chibana | 84/1.22 |
| 4,539,883 | 9/1985 | Chibana | 84/1.24 |

*Primary Examiner*—Stanley J. Witkowski
*Attorney, Agent, or Firm*—Spensley Horn Jubas & Lubitz

[57] ABSTRACT

A musical tone signal is synthesized on the basis of a predetermined modulation operation (e.g. an FM or AM operation) employing a modulation signal and a carrier signal respectively having an audio range frequency. In a waveshape table provided for defining at least one of a modulation wave function or a carrier wave function, a wave function expressed in a logarithmic form log{f(x)} is stored. The wave function log{f(x)} read out from this waveshape table is multiplied with a coefficient k whereby the wave function of the modulation signal or the carrier signal to be used in the modulation operation is changed from f(x) to $\{f(x)\}^k$. That is, k log{(f(x)}=log$\{f(x)\}^k$ is obtained by this multiplication and $\{f(x)\}^k$ is obtained by converting this log $\{f(x)\}^k$ to a linear form. Therefore, it is enabled to synthesize a tone having abundant frequency components by using the wave function $\{f(x)\}^k$ obtained by a simple operation.

23 Claims, 3 Drawing Sheets

TONE SYNTHESIS METHOD USING MODULATION OPERATION FOR AN ELECTRONIC MUSICAL INSTRUMENT

BACKGROUND OF THE INVENTION

This invention relates to a tone synthesis method in which a musical tone signal is synthesized by a frequency modulation operation or an amplitude modulation operation and, more particularly, to a tone synthesis method capable of controlling a relatively large number of frequency components by a simple operation.

Chowning, U.S. Pat. No. 4,018,121 discloses a fundamental technique for synthesizing a tone signal having a desired harmonic composition by a frequency modulation operation in which the carrier and modulating frequencies are both in the audio frequency range. For synthesizing a tone of a satisfactory tone color having sufficient harmonic components by employing the technique disclosed in this United States Patent however, a frequency modulation (abbreviated as FM hereunder) operation using a simple monomial expression is insufficient and it requires an FM operation of a multiplex or polynomial expression. This inevitably necessitates a synthesizing circuit with a complicated and large-scale construction and, in a system which performs the synthesis operation for each term on a time shared basis, a control clock of a high rate must be employed with a resulting high manufacturing cost. A tone synthesis technique using this type of multiplex or polynomial FM operation is disclosed in U.S. Pat. No. 4,253,367.

It has also been conceived, as a technique for synthesizing a tone containing abundant harmonic components by a relatively simple operation, to prestore a waveshape containing abundant frequency components in a waveshape memory and use its output as a modulation wave or a carrier wave. Since a waveshape usable for such operation is fixed to the one waveshape which has been stored in a waveshape memory, there is limitation in a tone color which can be synthesized by this technique. The same problem exists not only in the tone synthesis technique of the FM operation type but also in that of an amplitude modulation operation (abbreviated as AM hereunder) type.

It is an object of the present invention to provide, a technique of synthesizing a tone signal by a predetermined modulation operation, a method capable of synthesizing a tone signal having abundant frequency components with a relatively simple construction.

SUMMARY OF THE INVENTION

The tone synthesis technique according to the invention is characterized in that waveshape data is stored in a logarithmic form in a waveshape table used for generation of a modulation wave function or a carrier wave function, a multiplier means is provided for multiplying the logarithmic waveshape data read out from this table with any desired coefficient, changing a function of waveshape data which is antilogarithm of this logarithm by this coefficient multiplication and utilizing the changed function for the modulation operation. If a modulation wave or a carrier wave prepared in a waveshape table f is expressed by $f(\omega t)$, its logarithmic expression is $\log f(\omega t)$. If this $\log f(\omega t)$ is multiplied with a pre-established coefficient k, i.e., $k \cdot \log f(\omega t) = \log \{f(\omega t)\}^k$, then the antilogarithm of $k \cdot \log f(wt)$ becomes $\{f(\omega t)\}^k$ which is a function having a waveshape that is quite different from the original function $f(\omega t)$, containing more frequency components than the original function. The waveshape of the function $\{f(\omega t)\}^k$ obtained which can also be expressed as $f(wt) \cdot [f(wt)]^{k-1}$ is not limited to a single waveform having fixed harmonic content but may be varied by simply changing the value of the supplied waveshape changing coefficient k.

An advantageous result derived by practicing the above operation is that a tone signal containing abundant frequency components can be synthesized with a simple modulation operation (changing the supplied k), a predetermined waveshape of a modulation wave or a carrier wave prestored in a waveshape table is changed to a new waveshape containing more frequency components by a very simple operation and this changed waveshape is used for the modulation operation. Further, since the waveshape itself of the modulation wave or carrier wave can be changed by merely changing the value of the supplied coefficient k, a tone synthesis control for generating various tone colors can be realized with a very simple construction.

DESCRIPTION OF PREFERRED EMBODIMENTS

Figure 1:
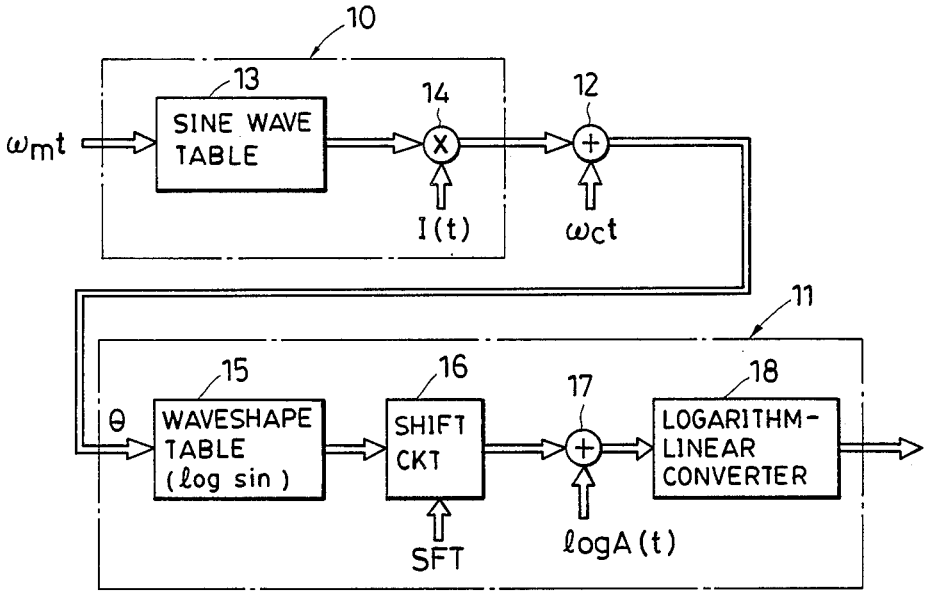
FIG. 1 is an electrical block diagram showing an embodiment of the present invention applied to the FM operation type tone synthesis technique.

FIG. 1 shows an embodiment of the invention applied to the FM modulation type tone synthesis method. This embodiment is adapted to execute a monomial FM operation equation. The circuit generally comprises a modulation wave function generation section 10, a carrier wave function generation section 11 and an adder 12 for phase-modulating a carrier wave. In the modulation wave function generation section 10, sine waveshape data $\sin \omega_m t$ is read out from a sine wave table 13 in response to a modulation wave phase angle data $\omega_m t$ and thereafter is multiplied with modulation index data I(t) in a multiplier 14. In the adder 12, modulation wave data $I(t) \sin \omega_m t$ provided by the multiplier 14 is added to carrier wave phase angle data $\omega_c t$ for performing phase-modulation of the carrier wave. The carrier wave function generation section 11 generates a predetermined carrier wave function in accordance with phase angle data of the phase-modulated carrier wave $\omega_c t + I(t) \sin \omega_m t$ provided by the adder 12 and, as a result, produces a frequency modulated signal.

In the embodiment of FIG. 1, the present invention is applied to the carrier wave function generation section 11. Waveshape data of a sine wave is prestored, in logarithm, in a waveshape table 15 and this logarithmic waveshape data is read out in response to phase angle data provided by the adder 12. A shift circuit 16 constitutes multiplication means for multiplying the logarithmic waveshape data read out from the waveshape table 15 with a coefficient k. The shift circuit 16 performs multiplication of $k=2^i$ (where i is any integer representing a shift amount) by shifting bits of the logarithmic waveshape data of binary digital data to the right (i.e., to less significant bit) or to the left (i.e., to more significant bit). The shift amount of the shift circuit 16 is designated by shift data SFT. If the phase angle data $\omega_c t + I(t) \sin \omega_m t$ provided from the adder 12 to the waveshape table 15 is represented by $\theta$, the read out output of the table 15 is $\log \sin \theta$ and the output of the shift circuit 16 is $2^i \log \sin \theta = \log (\sin \theta)^{2^i}$ whereby the carrier wave function which corresponds to antilogarithm of the logarithmic data has substantially been changed from $\sin \theta$ to $(\sin \theta)^{2^i}$.

The logarithmic waveshape data provided by the shift circuit 16 is applied to an adder 17 where amplitude weighting of the data is made using amplitude coefficient A(t). More specifically, amplitude coefficient data log A(t) expressed in logarithm is applied to the adder 17 and, by addition of logarithms, multiplication of antilogarithms is substantially effected, i.e., $\log (\sin \theta)^{2^i} + \log A(t) = \log A(t) \cdot (\sin \theta)^{2^i}$. The logarithmic waveshape data thus having been weighted in amplitude is applied to a logarithm-linear converter 18 where it is converted to waveshape data in the linear form (i.e., antilogarithm).

Figure 2:
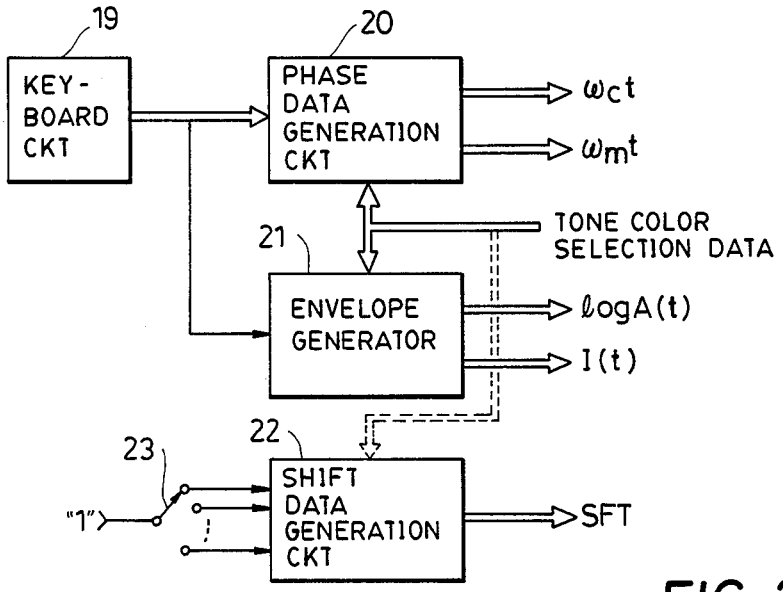
FIG. 2 is an electrical block diagram showing an example of a circuit for supplying operation parameters used in the circuit of FIG. 1.

The various parameters $\omega_m t$, $\omega_c t$, I(t), log A(t) and SFT used for the FM operation are provided by a circuit as shown in FIG. 2. A keyboard circuit 19 detects a key depressed in a keyboard of an electronic musical instrument and thereupon produces depressed key data. A phase data generation circuit 20 generates, in response to the depressed key data provided by the keyboard circuit 19, modulation wave phase angle data $\omega_m t$ and carrier wave phase angle data $\omega_c t$ at a period corresponding to the tone pitch of the depressed key. An envelope generator 21 generates, in response to depression of the key, modulation index data I(t) and amplitude coefficient data log A(t) as functions of time. Tone color selection data is supplied from a tone color selection device (not shown) to the phase data generation circuit 20 and the envelope generator 21 and the frequency ratio between $\omega_c t$ and $\omega_m t$ and time functions of I(t) and A(t) are thereby controlled in accordance with the tone color. A shift data generation circuit 22 generates shift data SFT by operating a selection switch 23. The shift data generation circuit 23 may be so constructed that it will generate predetermined shift data SFT in response to tone color selection data.

Figure 3:
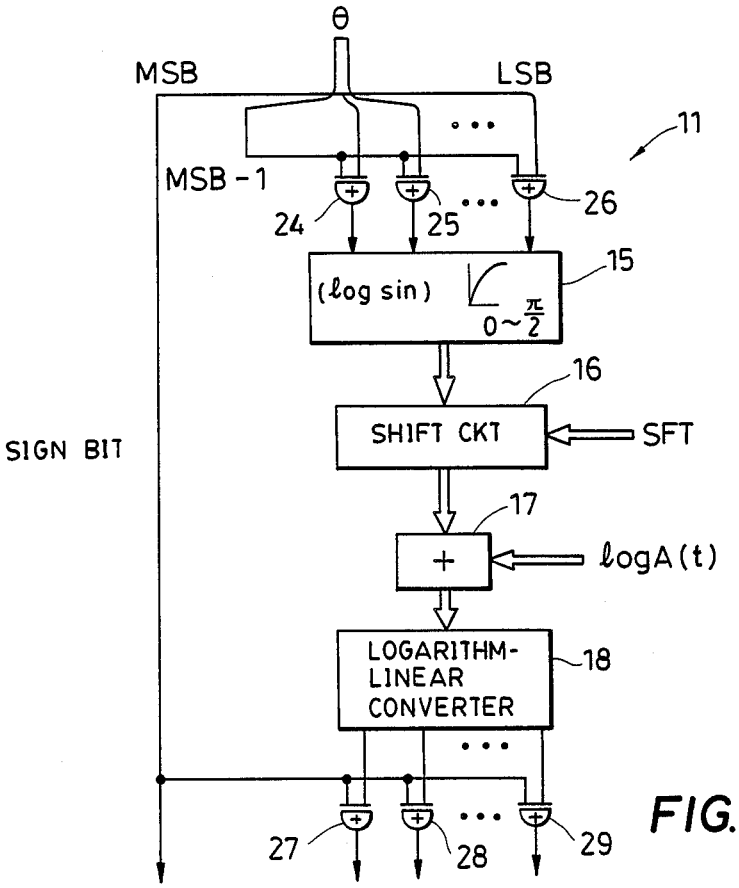
FIG. 3 is a block diagram showing a specific example of a carrier wave generation section in FIG. 1.
Figure 4A:
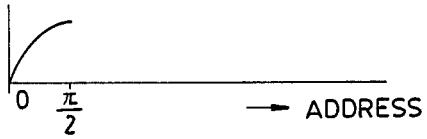
FIGS. 4*a*–4*d* are diagrams showing examples of waveshapes of output data from respective portions of FIG. 3.
Figure 4B:
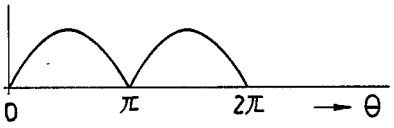

FIG. 3 shows a specific example of the carrier function generation section 11 in FIG. 1. In the waveshape table 15, a quarter period waveshape of a sine wave (FIG. 4*a*) corresponding to an angular range between 0 and $(\pi/2)$ is stored in logarithm. The most significant bit MSB of the phase angle data $\theta$ is used as a sign bit indicating polarity of the waveshape data and the second bit MSB-1 counting from the MSB is used for switching reading direction of the waveshape table 15 upon elapse of each quarter period. Exclusive OR gates 24, 25, . . . , 26 are provided for respective bits excluding the two bits MSB and MSB-1 of the phase angle data $\theta$ and these respective bits are applied to one inputs of these exclusive OR gates 24 through 26. To other inputs of these exclusive OR gates 24 through 26 is commonly applied the second most significant bit MSB-1. This bit MSB-1 is "0" when the first and third quarter periods of the sine waveshape are read out, causing the less significant bits of data $\theta$ applied to the exclusive OR gates 24–26 to pass through these gates 24–26 and to be applied to an address input of the waveshape table 15. The bit MSB-1 is "1" when the second and last quarter periods are read out, causing the less significant bits of data $\theta$ to be inverted by the exclusive OR gates 24–26 and thereafter to be applied to the address input of the waveshape table 15. Accordingly, the reading direction of the waveshape table 15 is inverted each quarter period and waveshape data as shown in FIG. 4*b* is read out in logarithm. This logarithmic waveshape data is shifted to the right or left by a suitable amount in the shift circuit 16, as was described previously, and supplied to the logarithm-linear converter 18 after being weighted by the amplitude coefficient A in the adder 17. By the shifting in the shift circuit 16, the function of waveshape data which is antilogarithm of the logarithmic data is changed to $(\sin \theta)^{2^i}$ as described above ($\theta$ is $0 \leqq \theta \leqq \pi$ because the control is directed to a half period of a positive polarity in a sine wave).

Figure 4C:
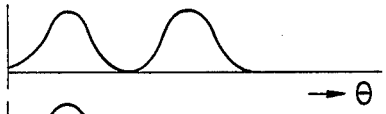
Figure 4D:
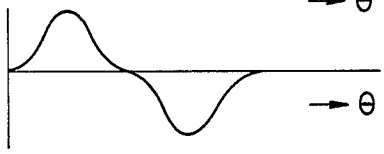

The respective bits of the waveshape data provided by the logarithm-linear converter 18 are applied to one inputs of exclusive OR gates 27, 28, . . . , 29 provided for these bits. To other inputs of these exclusive OR gates 27, 28 and 29 is commonly applied a sign bit (i.e. MSB of the data $\theta$). When the sign bit is "0" (representing the positive polarity), waveshape data is passed as it is whereas the sign bit is "1" (representing the negative polarity), the respective bits of the waveshape data are inverted to produce 1's complement. In this manner, the waveshape data is converted in the exclusive OR gates 27–29 to a data form for which the polarity has been taken into account. If the linear waveshape data produced from the logarithm-linear converter 18 assumes a form as shown in FIG. 4*c*, the waveshape data for which the polarity has been taken into account assumes a form as shown in FIG. 4*d*.

An example of a function obtained in accordance with the shift amount in the shift circuit 16 will now be described.

In a case where the read out output from the waveshape table 15 is shifted by one bit to the right, the coefficient $2^i$ is $2^{-1}=\frac{1}{2}$ so that the logarithmic waveshape data produced by the shift circuit 16 becomes $\frac{1}{2} \log \sin \theta = \log \sin \frac{1}{2}\theta$ and the carrier function obtained as antilogarithm of this logarithmic waveshape data can be expressed by employing $\sqrt{\sin \theta}$ ($\theta$ being $0 \leqq \theta < \pi$). Since the finally obtained function in the range of $\pi \leqq \theta < 2\pi$ is one obtained by inverting $\sqrt{\sin \theta}$ where $\theta$ is $0 \leqq \theta < \pi$ to the negative polarity, a waveshape (solid line) which is distorted to the outside of the sine wave (dotted line) as shown in FIG. 5*a* is obtained.

In a case where the read out output from the waveshape table 15 is shifted by one bit to the left, the coefficient $2^i$ is $2^1=2$ so that the logarithmic waveshape data produced from the shift circuit 16 becomes $2 \log \sin \theta = \log \sin^2 \theta$ and the function obtained as its antilogarithm can be expressed by employing $\sin^2 \theta = (1 - \cos 2\theta/2)$ (where $0 \leqq \theta < \pi$). In the same manner as was previously described, since the finally obtained function in the range of $\pi \leqq \theta < 2\pi$ is one obtained by inverting $\sin^2 \theta$ where $\theta$ is $0 \leqq \theta < \pi$ to the negative polarity, a waveshape (solid line) which is distorted to the inside of the sine wave (dotted line) as shown in FIG. 5(*b*).

Figure 5A:
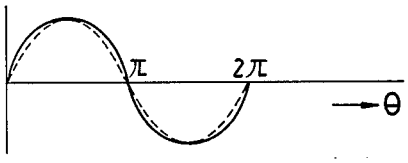
FIGS. 5*a* and 5*b* are graphs showing an example of a function obtained finally in the circuit of FIG. 3 with respect to different shift amounts (i.e., coefficients)
Figure 5B:
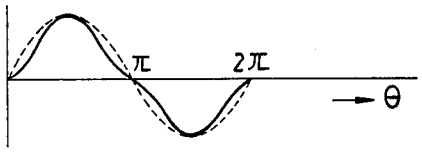

Further increase in the shift amount will result in generation of a waveshape which is more distorted than the waveshapes shown in FIGS. 5*a* and 5*b*. The function obtained can be generally expressed by $(\sin \theta)^{2i}$ in the range of $0 \leqq \theta < \pi$ and by the inverted form of $(\sin \theta)^{2i}$ of $0 \leqq \theta < \pi$, i.e., $-\sin \{(\theta - \pi)\}^{2i}$ in the range of $0 \leqq \theta < 2\pi$.

Since in the carrier function generation section 11, the phase angle data $\theta$ is $\omega_c t + I(t) \sin \omega_m t$ which has already been phase-modulated, the waveshape data provided actually by the logarithm-linear converter 18 assumes a more complicated waveshape than those shown in FIGS. 5*a* and 5*b* (waveshapes obtained by FM modulating the waveshapes of FIGS. 5*a* and 5*b* with a sine wave).

Figure 6:
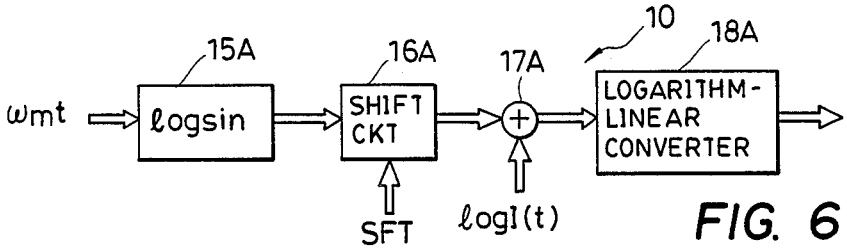
FIG. 6 is a block diagram showing an example of a modulation function generation section in FIG. 1 which has been modified by applying the present invention.

It is of course possible to apply this invention to the modulation wave function generation section 10 in FIG. 1. In this case, the circuit is constructed in the same manner as the carrier wave function generation section 11 as shown in FIG. 6. More specifically, waveshape data of a sine wave is stored in logarithm in a waveshape memory 15A and this is read out in response to the modulation wave phase angle data $\omega_m t$. Of course, it is unnecessary to provide the waveshape memory 15A if the waveshape memory 15 in FIG. 1 is on time division basis used commonly to generate the modulation wave function and the carrier wave function. Shift circuit 16A, adder 17A and logarithm-linear converter 18A are the same as those shown in FIG. 1 but an adder 17A adds modulation index data log I(t) expressed in logarithm. The output $I(t) (\sin \omega_m t)^{2i}$ of the logarithm-linear converter 18A is applied to the adder 12 to modulate the carrier phase $\omega_c t$. In this case, this invention may be applied to the modulation wave function generation section 10 only and not to the carrier wave function generation section 11. Alternatively, the invention may be applied to both.

As described above, the fundamental FM operation equation in a monomial form originally is $A(t) \sin \{\omega_c t + I(t) \sin \omega_m t\}$, but according to the present invention, it is changed to $A(t)[\sin \{\omega_c t + I(t) \sin \omega_m t\}]^{2i}$ or $A(t) \sin \{\omega_c t + I(t) \sin^{2i} \omega_m t\}$, or $A(t)\{\sin \omega_c t + I(t) \sin^{2i} \omega_m t\}$, or $A(t)[\sin \{\omega_c t + I(t) \sin^{2i} \omega_m t\}]^{2i}$ (where $0 \leqq \theta < \pi$) whereby a tone signal which has more abundant frequency components and in which control of more frequency components is possible can be synthesized.

Figure 7:
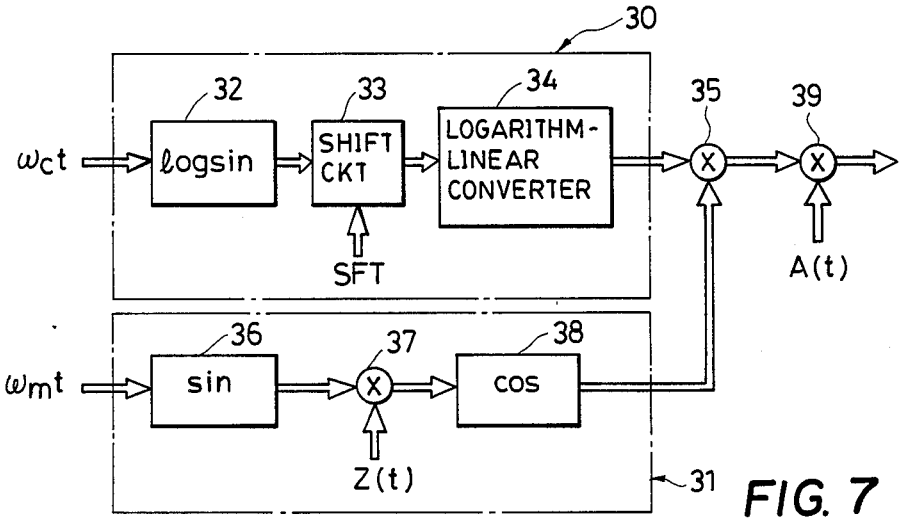
FIG. 7 is a block diagram showing an embodiment of the invention applied to the AM operation type tone synthesis technique.

FIG. 7 shows an embodiment in the tone synthesis method of the AM operation type. This embodiment is adapted to execute a monomial AM operation equation. The invention is adapted to a carrier function generation section 30 which includes a waveshape table 32 storing sine waveshape data in logarithm, a shift circuit 33 shifting read out data SFT from the waveshape table 32 in response to the shift data SFT, and a logarithm-linear converter 34 converting the output of the shift circuit 33 to data in the linear form. Phase angle data $\omega_c t$ of the carrier wave is applied to the waveshape table 32. For the same reason as was previously described, waveshape data $(\sin \omega_c t)^{2i}$ containing more frequency components is provided by the logarithm-linear converter 34 and this data is applied as a carrier wave signal to a multiplier 35 provided for amplitude modulation.

In a modulation wave function generation section 31, a sine wave table 36 is read in response to the phase angle data $\omega_m t$ of the modulation wave, its read out output is multiplied with modulation index Z(t) in a multiplier 37 and a cosine wave table 38 is read by an output of the multiplier 37. The waveshape data $\cos \{Z(t) \sin \omega_m t\}$ read out from the cosine wave table 38 is applied to a multiplier 35 as a modulation wave signal and thereupon the amplitude modulation operation is performed. The output of the multiplier 35 is applied to a multiplier 39 where the amplitude coefficient A(t) is multiplied.

A specific circuit of the carrier wave function generation section is constructed as shown in FIG. 3. This invention may also be applied to the sign wave table 36 or the cosine wave table 37 in the modulation wave function generation section 31. In this case; such table may be constructed of a waveshape table in a logarithmic form, a shift circuit and a logarithmic linear converter.

The waveshape stored in the waveshape tables 15, 15A and 32 is not limited to a sine wave but any desired waveshaped such as a cosine waveshape, a triangular waveshape, a square waveshape or other complicatied waveshape may be stored in logarithm. The shift circuits 16, 16A and 33 may be constructed by a general multiplication means (i.e. multiplier or divider) and a desired coefficient k may be multiplied with the logarithmic waveshape data. Further, the present invention is applicable not only to a tone synthesis method using the monomial FM or AM operation but to any suitable portion of a tone synthesis method using a polynomial, multiplex or circulating type FM or AM operation in any suitable portion.

What is claimed is:

1. In a method for synthesizing a musical tone signal on the basis of a predetermined modulation operation employing a modulation signal and a carrier signal, the steps comprising:

storing waveshape data representing a waveshape of a predetermined first harmonic content and expressed in a logarithmic form in a waveshape table used for defining at least one of a modulation wave function and a carrier wave function;

multiplying said waveshape data read out from said waveshape table with a pre-established coefficient to obtain data expressed in logarithmic form and representing a waveshape having a second harmonic content different from the first harmonic content; and executing said modulation operation by utilizing the multiplied result as said modulation signal or said carrier signal.

2. A tone synthesis method as defined in claim 1 wherein the steps further comprises:

converting said multiplied result to a linear form.

3. A tone synthesis method as defined in claim 1 wherein the multiplication of said waveshape data and said coefficient is executed by using a shift circuit for bit-shifting said waveshape data by the number corresponding to i when said coefficient is represented by $2^i$, where i is any integer.

4. A tone synthesis method as defined in claim 1 wherein said waveshape data is data representing a sine function or a cosine function in logarithmic form.

5. A tone synthesis method as defined in claim 1 wherein said predetermined modulation operation is a predetermined frequency modulation operation.

6. A tone synthesis method as defined in claim 1 wherein said predetermined modulation operation is a predetermined amplitude modulation operation.

7. An apparatus for synthesizing a musical tone comprising:

means for supplying modulation phase angle data representing a progressive phase angle value of a modulation signal;

means for supplying carrier phase angle data representing a progressive phase angle value of a carrier signal;

means for supplying a waveshape changing coefficient;

means for supplying a modulation index; and modulation operation means for executing a predetermined modulation operation employing said modulation phase angle data and said carrier phase angle data to synthesize a musical tone;

said modulation operation means comprising a modulation waveshape table storing first periodic waveshape data defining said modulation signal and a carrier waveshape table storing second periodic waveshape data defining said carrier signal, at least one of said first and second periodic waveshape data including sample point data representing a periodic function which defines a respective one of said modulation signal and said carrier signal, said sample point data being expressed in logarithmic form, and further comprising multiplier means for multiplying said sample point data with said waveshape changing coefficient to obtain a multiplied result, and conversion means, coupled to said multiplier means, for obtaining a tone signal which includes the antilogarithm of said multiplied result.

8. An apparatus as defined in claim 7 wherein;

said modulation waveshape table produces said modulation signal in accordance with said modulation phase angle data; further including an index multipler for multiplying said modulation wave signal with said modulation index;

an adder for adding said carrier phase angle data to the result provided by said index multiplier and for outputting a modulated carrier phase angle data; and wherein said carrier waveshape table reads out said carrier signal in accordance with said modulated carrier phase angle data.

9. An apparatus as defined in claim 8 wherein said carrier waveshape table stores data representing a periodic function defining said carrier signal expressed in the logarithmic form.

10. An apparatus as defined in claim 8 wherein said modulation waveshape table stores data representing a periodic function defining said modulation signal expressed in the logarithmic form.

11. An apparatus as defined in claim 7 wherein said modulation waveshape table and said carrier waveshape table consist of a common waveshape table used on a time shared basis.

12. An apparatus as defined in claim 7 wherein;

said modulation waveshape table produces said modulation signal in accordance with said modulation phase angle data;

said carrier waveshape table produces said carrier signal in accordance with said carrier phase angle data; and including a circuit for amplitude-modulating said carrier signal in accordance with said modulation signal.

13. An apparatus as defined in claim 7 further comprising shift register means to which a shift instruction defining said waveshape changing coefficient is supplied.

14. An apparatus as defined in claim 7 wherein said multiplier means comprises shift circuit means for shifting said waveshape data by i bits where said wave changing coefficient is represented by $2^i$, and i is a supplied integer.

15. In a method for synthesizing a musical tone signal by modulating a carrier signal by modulation signal, the steps comprising:

storing waveshape data representing sample points of a predetermined waveshape having a first harmonic content in a waveshape table, said sample points being expressed in a logarithmic form, said predetermined waveshape defining at least one of a modulation wave function and a carrier wave function;

supplying a waveshape changing coefficient;

multiplying said waveshape data read out from said waveshape table with said waveshape changing coefficient to obtain sample points in logarithmic form representative of a waveshape having a second harmonic content different from the first harmonic content; and utilizing the results of the multiplication to form at least one of said modulation signal and said carrier signal.

16. A tone synthesis method as defined in claim 15 wherein the multiplication of said waveshape data and said waveshape changing coefficient is executed by using a shift circuit for bit-shifting said waveshape data by i bits, where said waveshape changing coefficient is represented by $2^i$, and i is a supplied integer.

17. A tone synthesis method as defined in claim 15 wherein said waveshape data includes data representing sample points of at least one of a sine function and a cosine function, said sample points being expressed in logarithmic form.

18. A tone synthesis method as defined in claim 15 wherein said modulation and carrier signals are combined in a frequency modulation operation.

19. A tone synthesis method as defined in claim 15 wherein said modulation and carrier signals are combined in an amplitude modulation operation.

20. A tone synthesis method as defined in claim 15 wherein the results of the multiplication are utilized to form the carrier signal, the method further including the steps of:

modulating the carrier signal by the modulation signal to obtain a modulated output; and coupling the modulated output to a logarithm to linear converter to obtain a tone signal.

21. A tone synthesis method as defined in claim 15 wherein the results of the multiplication are utilized to form the modulation signal, the method further including the steps of:

coupling the results of the multiplication to a logarithm to linear converter; and utilizing the output of the converter to control modulation of the carrier signal to obtain a tone signal.

22. An apparatus for synthesizing a musical tone signal comprising:

(i) carrier generating means for generating a carrier signal, said carrier generating means comprising:

storing means for storing waveshape data expressed in a logarithmic form, coefficient generating means for generating a coefficient, and multiplying means for multiplying said waveshape data with said coefficient, the multiplied result being used as said carrier signal;

(ii) modulation signal generating means for generating a modulation signal; and (iii) modulation means for modulating said carrier signal in accordance with said modulation signal, the modulated carrier signal being used to form said musical tone signal.

23. An apparatus for synthesizing a musical tone signal comprising:

(i) carrier generating means for generating a carrier signal;

(ii) modulation signal generating means for generating a modulation signal, said modulation signal generating means comprising:

storing means for storing waveshape data expressed in a logarithmic form, coefficient generating means for generating a coefficient, and multiplying means for multiplying said waveshape data with said coefficient, the multiplied result being used to form said modulation signal; and (iii) modulation means for modulating said carrier signal in accordance with said modulation signal, the modulated carrier signal being used to form said musical tone signal.

* * * * *